US006164802A

United States Patent [19]

Gromotka

[11] Patent Number: 6,164,802

[45] Date of Patent: Dec. 26, 2000

[54] STACKABLE HOUSING

[75] Inventor: Gabriel P. Gromotka, Hanover Park, Ill.

[73] Assignee: Cooper Technologies Company, Houston, Tex.

[21] Appl. No.: 09/220,678

[22] Filed: Dec. 23, 1998

[51] Int. Cl.[7] ..... F21V 21/02

[52] U.S. Cl. ..... 362/375; 362/372; 362/364; 362/147

[58] Field of Search ..... 362/362, 364, 362/374, 375, 372, 147, 148

[56] References Cited

U.S. PATENT DOCUMENTS

| | | | |
|---|---|---|---|
| 3,040,172 | 6/1962 | Chan | 362/364 X |
| 3,858,042 | 12/1974 | Peterson | 362/374 |
| 4,290,098 | 9/1981 | Pierson | 362/267 |
| 4,566,057 | 1/1986 | Druffel | 362/364 |
| 4,670,822 | 6/1987 | Baker | 362/226 |
| 4,760,510 | 7/1988 | Lahti | 362/365 |
| 4,872,097 | 10/1989 | Miller | 362/226 |
| 4,930,054 | 5/1990 | Krebs | 362/149 |
| 4,972,339 | 11/1990 | Gabrius | 362/366 |
| 5,073,845 | 12/1991 | Aubrey | 362/226 |
| 5,075,831 | 12/1991 | Shringer et al. | 362/364 X |
| 5,222,800 | 6/1993 | Chan et al. | 362/147 |
| 5,374,812 | 12/1994 | Chan et al. | 220/3.6 |
| 5,398,179 | 3/1995 | Pacheco | 362/364 |
| 5,452,816 | 9/1995 | Chan et al. | 220/3.8 |
| 5,581,448 | 12/1996 | Harwood | 362/147 |
| 5,588,737 | 12/1996 | Kusmer | 362/148 |
| 5,597,234 | 1/1997 | Winkelhake | 362/364 |
| 5,662,413 | 9/1997 | Akiyama | 362/365 |
| 5,738,436 | 4/1998 | Cummings et al. | 362/294 |
| 5,758,959 | 6/1998 | Sieczkowski | 362/365 |
| 5,800,051 | 9/1998 | Grampe et al. | 362/348 |
| 5,826,970 | 10/1998 | Keller et al. | 362/147 |

*Primary Examiner*—Laura K. Tso
*Attorney, Agent, or Firm*—Fish & Richardson, PC

[57] ABSTRACT

A lighting fixture includes a first open end, a second end, a movable dividing plate positioned between the first and second ends, and a release mechanism. The dividing plate defines a light compartment extending from the open end to the plate and a wiring compartment extending from the plate to the second end. The release mechanism is designed to release the plate to move the plate to permit access to the wiring compartment from the first end. The lighting fixture may stacked with other lighting fixtures of the same type, with the second end of one fixture inserted into the first open end of an adjacent fixture.

17 Claims, 8 Drawing Sheets

STACKABLE HOUSING

TECHNICAL FIELD

The invention relates to a recessed lighting fixture having an integral wiring compartment.

BACKGROUND

A typical recessed lighting fixture often includes three major components: a housing, decorative trim, and a junction box. The housing, which is installed in the ceiling between floor joists, provides means for installation of, and a chamber to house a socket and a lamp.

The trim has a decorative function in that it covers the front of the fixture and any imperfections in the opening of the ceiling. The trim also may serve more practical functions. For example, the trim may serve to protect the lamp, to hold and direct the lamp, to create a desired lighting pattern, and to form an insulating seal between the environment in the room and the space above the ceiling.

A common approach to attaching the trim to the housing uses two extension springs attached to the trim and having hooks on their ends. To install the trim, the springs are extended and the hooks are attached to receptacles inside the housing. Subsequent contraction of the extended springs pulls the trim against the ceiling.

Another approach uses torsion springs attached to the trim. The springs are compressed and their legs are placed in receptacles within the housing. Expansion of the torsion springs exert an upward force on the trim.

A third approach uses friction to keep the trim in the housing. Springs, such as leaf springs, mounted on the trim exert radial force on the lamp housing to keep the trim in place. This approach also may employ sharp barbs on the springs, trim, or housing to further secure the trim.

The junction box provides a location to connect the wires of the lighting fixture to the supply wires that provide power to the lamp. Junction boxes typically are placed adjacent to the housing, and also may be mounted on the side of the housing. Wires pass from the junction box to the lamp socket in the housing.

SUMMARY

In one general aspect, a lighting fixture includes a first open end, a second end, a movable dividing plate positioned between the first and second ends, and a release mechanism. The dividing plate defines a light compartment extending from the first end to the plate and a wiring compartment extending from the plate to the second end. The release mechanism is configured to release the plate to permit access to the wiring compartment from the first end.

Embodiments may include one or more of the following features. For example, the second end of the lighting fixture may be closed. A wall of the wiring compartment may include at least one opening configured to permit insertion of wires into the wiring compartment. The housing may include at least one opening configured to permit insertion of wires into the wiring compartment.

The release mechanism may include a slot in the wall of the housing and a movable tab slidably mounted on the dividing plate and configured to pass through the slot when the dividing plate is installed in the housing. The dividing plate may include a wireform spring in contact with the movable tab to bias the tab in the slot. The wall of the housing may have a second slot and the dividing plate may have a fixed tab. The fixed tab may be configured to pass through the second slot when the dividing plate is installed in the housing.

The lighting fixture may also include a socket positioned in the light compartment and having a pair of socket wires extending into the wiring compartment. A thermal circuit interrupter may be positioned in the wiring compartment. The lighting fixture may be a recessed light fixture housing.

The lighting fixture may also include an open end defining an inner groove, a reflector having a trim body, and at least one wireform spring. The spring may be attached to the trim body at two points and may have a central portion configured to fit in the groove when the trim body is attached to the housing.

The lighting fixture may be generally cylindrical. It also may be tapered from a wider first end to a narrower second end so that it is stackable by inserting the narrower end of one fixture into the open wider first end of another fixture.

Additional lighting fixtures may be stacked to form a larger stack of lighting fixtures. The stacked lighting fixtures may be transported or stored in the stacked form. The stacked housing takes up less space, which reduces shipping and storage costs.

The stackable housing offers the considerable advantage of providing a mechanism to easily modify or inspect the wiring in the housing's integral wire compartment without removing the housing—only the removable plate must be removed to access the wiring compartment. The stackable housing also provides a housing at a cost lower than conventional housings having external wire junction boxes because the external junction box does not need to be manufactured and assembled.

Other features and advantages will be apparent from the following description, including the drawings, and from the claims.

DESCRIPTION

Figure 1:
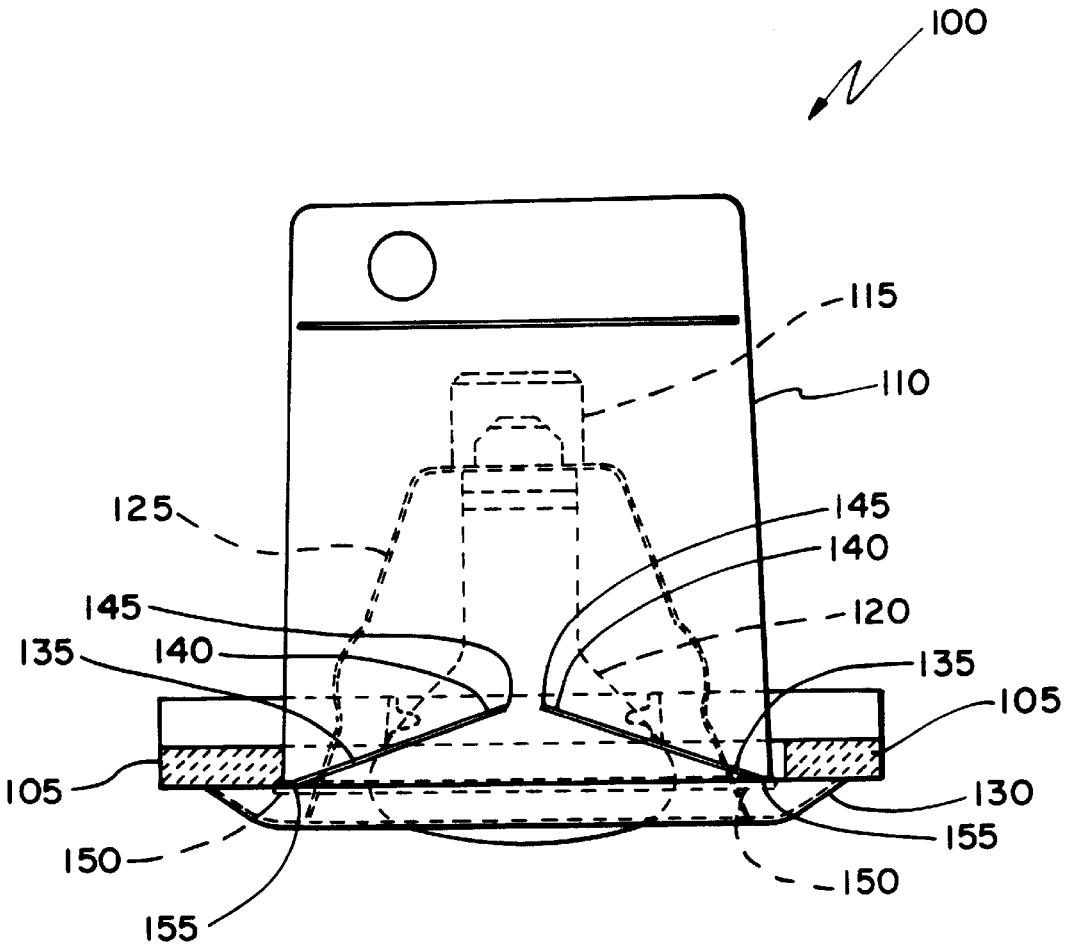
FIG. 1 is a cross-sectional front view of a recessed lighting fixture.

Referring to FIG. 1, a recessed lighting fixture 100 installed in a ceiling 105 includes a housing 110. The housing 110 is generally cylindrical in shape, with a diameter gradually increasing from the top to the bottom. Typically, the housing 110 is made from unfinished metal. A lamp socket 115, in which a lamp 120 may be installed, is secured within the housing.

A reflector 125 is removably and rotatably positioned within the housing. The reflector 125 includes a trim body 130 that extends from the housing to cover a housing opening in the ceiling. The trim body 130 may define an irregularly shaped opening such that the rotational orientation of the trim body affects a pattern of light produced by the fixture. Typically, the reflector is made from painted metal.

Figure 2:
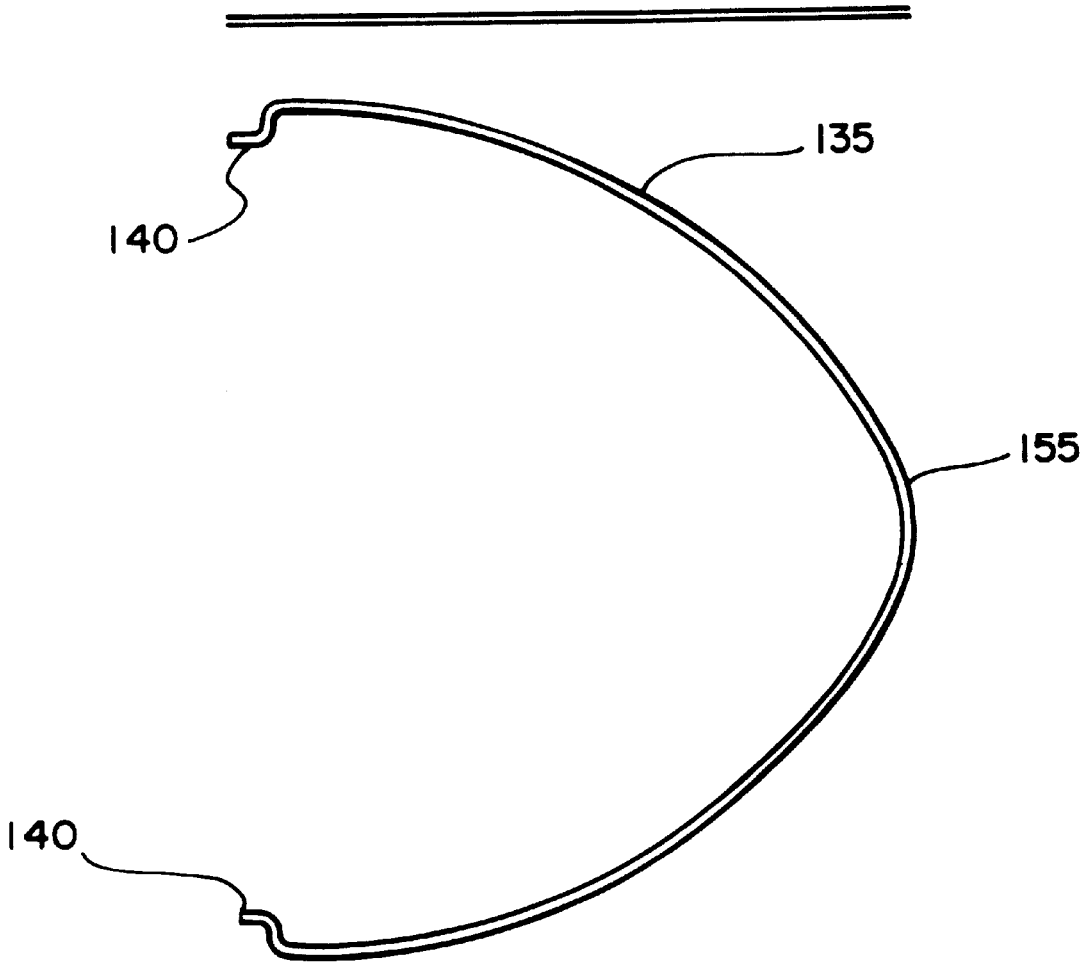
FIG. 2 is a top view of a wireform spring of the fixture of FIG. 1.

Referring also to FIG. 2, a pair of wireform springs 135 serve to secure the reflector in the housing with the trim body snug against the ceiling. Wireform springs 135 are pivotably attached to trim body 130 by mounting ends 140 inserted into holes 145 in the trim body. Wireform springs 135 are slidably installed in a groove 150 on the inside perimeter of housing 110. Only an outer bend 155 of each wireform spring 135 is in contact with housing 110. The outer bend 155 can slide in the groove 150 to rotate the reflector. After installation, the wireform springs 135 are in a compressed state and exert a force that pulls trim body 130 upward against ceiling 105.

Figure 3:
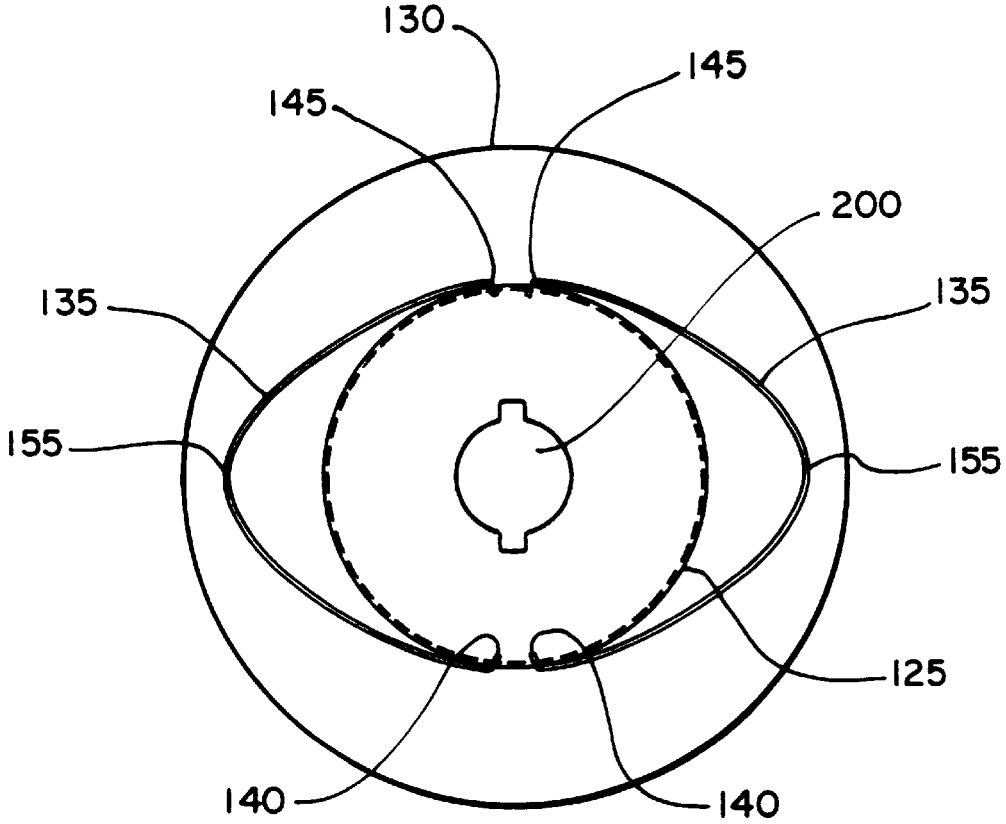
FIGS. 3 and 4 are top and side views of a reflector of the fixture of FIG. 1.
Figure 4:
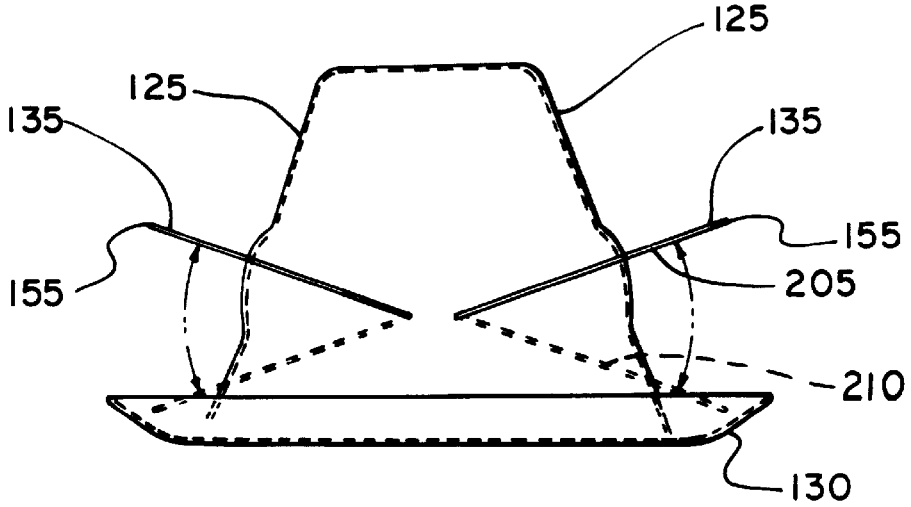

Referring also to FIGS. 3 and 4, reflector 125 includes an opening 200 through which socket 115 passes when reflector 125 is mounted in housing 110. Wireform springs 135, which are pivotably installed in holes 145, can move between a mounting position 205 and an installed position 210. The springs 135 are compressed while moving from the mounting position 205 to the installed position 210. The springs 135 remain in a compressed state when in the installed position 210.

Figure 5:
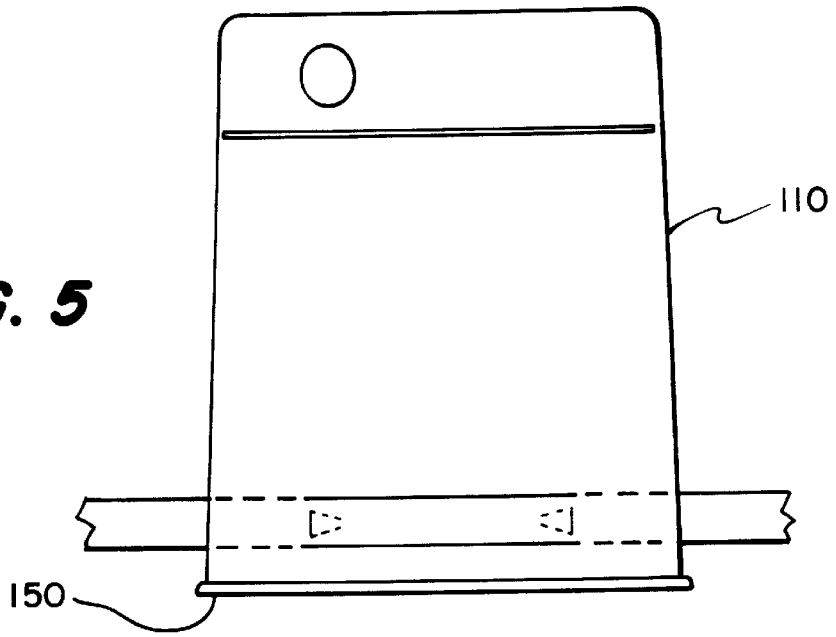
FIGS. 5 and 6 are front and bottom views of a housing of the fixture of FIG. 1.
Figure 6:
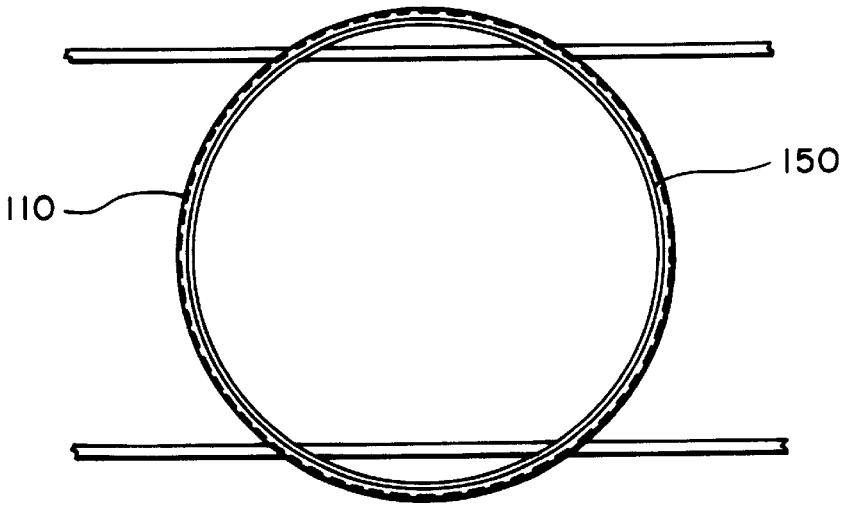
Figure 7:
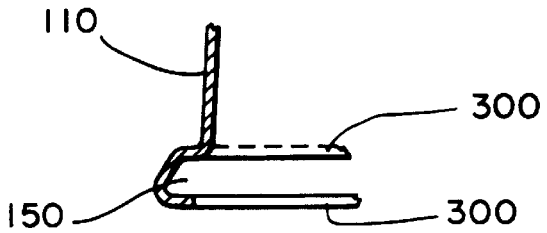
FIG. 7 is an enlarged view of a groove of the housing of FIG. 6.

Referring also to FIGS. 5–7, the groove 150 of housing 110 may have an inside diameter that is greater than the inside diameter of housing 110. The groove 150 is defined by a pair of shoulders 300 that retain springs 135 within groove 150. Alternatively, the groove may have an inside diameter less than or equal to the inside diameter of the housing, and may be defined by ridges extending from the inside of the housing.

Figure 8:
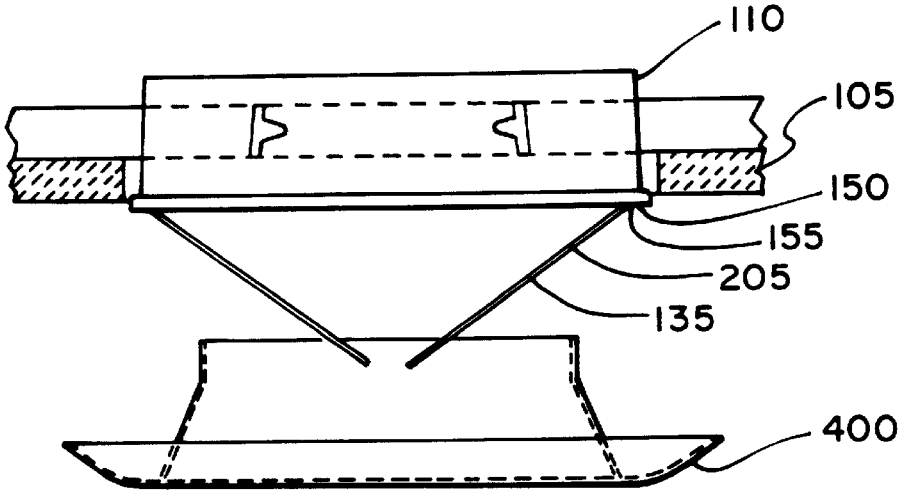
FIGS. 8–10 are front views of the recessed lighting fixture of FIG. 1 with, respectively, wireform springs initially placed in a groove, parallel to the groove, and in the installed position.
Figure 9:
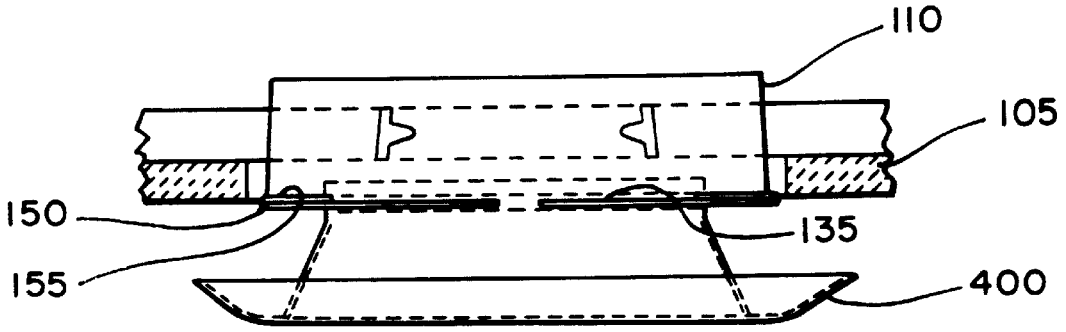
Figure 10:
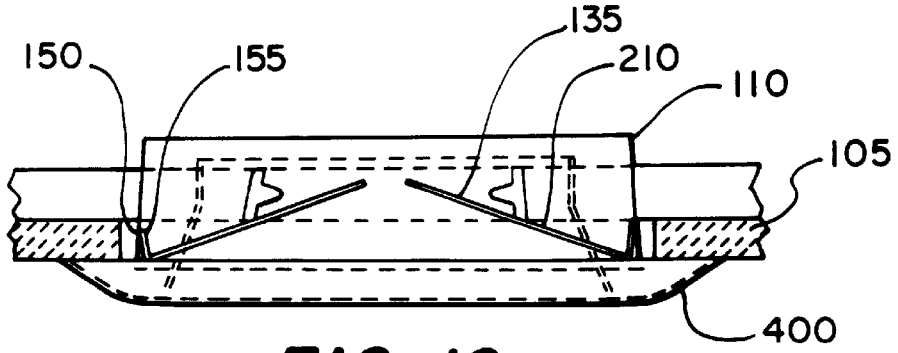

FIGS. 8–10, illustrate the method of installing a trim body 400 into the housing 110 after the housing is mounted in the ceiling 105. Unlike the trim body 130, the trim body 400 includes only a partial reflector 405. However, installation of trim body 400 proceeds in the same way as installation of trim body 130.

Referring to FIG. 8, outer bends 155 of springs 135 are placed in groove 150 in the mounting position 205. Then, referring to FIG. 9, trim body 400 is pushed into housing 110. As trim body 400 is pushed into housing 110, the wireform springs 135 are compressed. At the point in which the springs 135 are parallel to the groove 150, the compression on the springs is the highest. Once the trim body passes this point, expansion of the springs pulls the trim body into the housing. Referring to FIG. 10, when the trim body 400 is seated against the ceiling, the compression in the springs 135 exerts an upward force on the trim body. This force keeps the trim body seated in the housing 110 and against the ceiling.

Figure 11:
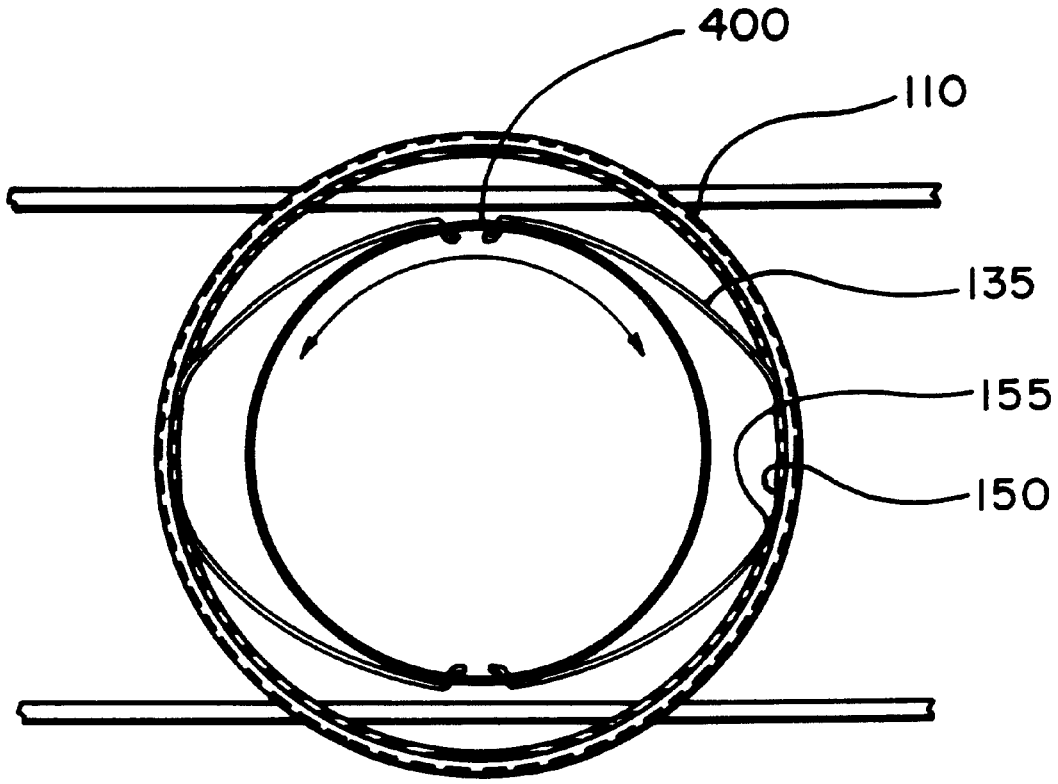
FIG. 11 is a top view of the installed reflector of FIG. 10 illustrating rotation of the reflector relative to the housing.

Referring to FIG. 11, the reflector 125 can rotate in the housing 110 because the only rotation constraint on the trim body is the frictional force between outer bends 155 and groove 150. Thus, the reflector 125 (and trim body 400) can be rotated clockwise and counter-clockwise within housing 110. Such rotation is necessary for trim bodies that are used to direct light or to otherwise affect the pattern of light produced by the fixture.

Figure 12:
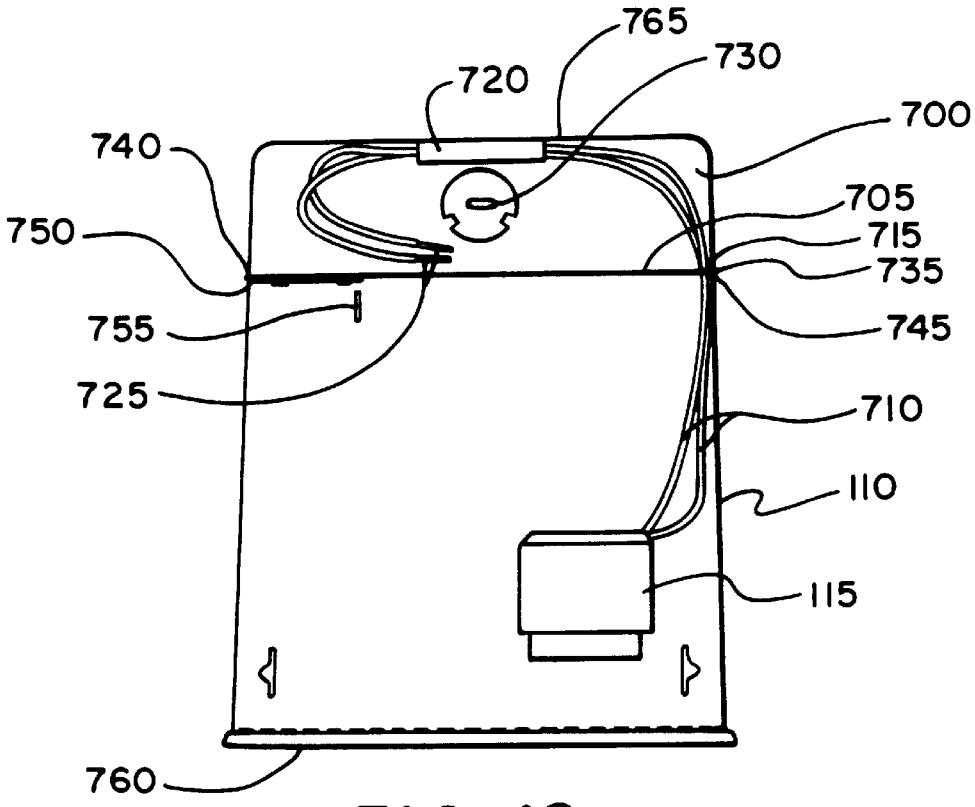
FIGS. 12 and 13 are front and bottom views of the housing illustrating an integral wiring compartment.
Figure 13:
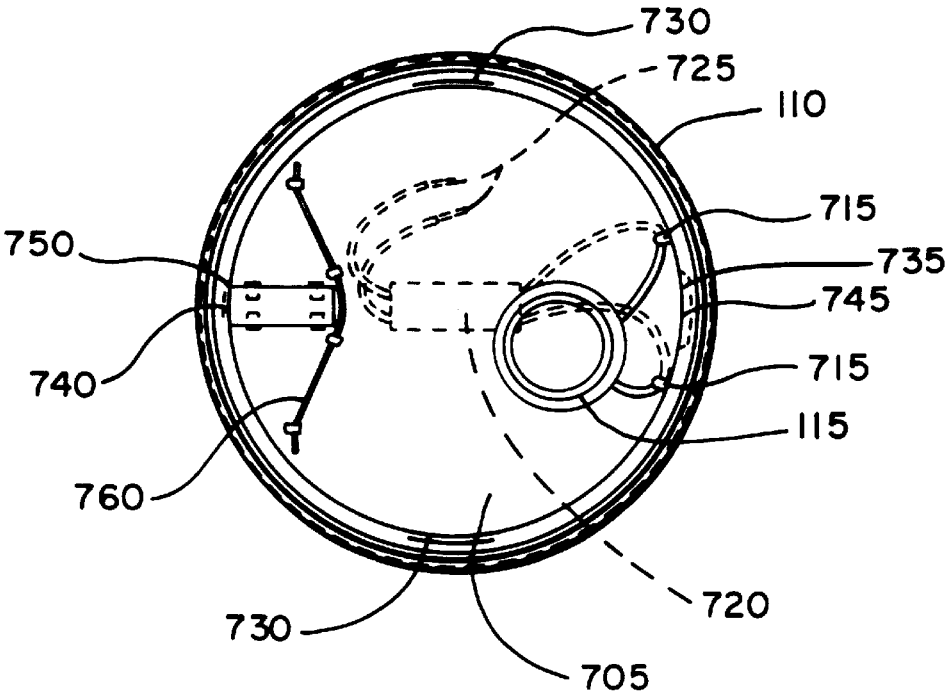

Referring to FIGS. 12 and 13, housing 110 may include an integral wiring compartment 700 that is separated from the remainder of housing 110 by a removable dividing plate 705. A pair of socket wires 710 are connected to socket 115 and pass through a pair of openings 715 in dividing plate 705. One of the socket wires 710 includes a thermal circuit interrupter 720. The socket wires 710 terminate in the wiring compartment at ends 725. Electrical supply wires (not shown) may pass through an opening 730 in housing 110 for connection with the socket wires 710 at the ends 725.

The dividing plate 705 includes a fixed tab 735 and a movable tab 740. Tabs 735 and 740 fit within slots 745 and 750, respectively, on the side of housing 110. Movable tab 740 is attached to a handle 755. A wireform spring 760 is mounted on dividing plate 705 and rests against handle 755 to bias movable tab 740 into slot 750. To remove dividing plate 705 from housing 110, handle 755 is moved toward the center of plate 705, which pulls tab 740 out of slot 750 and releases the plate from the housing.

To connect the socket wires 710 to the supply wires after housing 110 is mounted in the ceiling, a cable including the supply wires is passed through opening 730 and the supply wires are connected to the socket wires 710 at ends 725. Dividing plate 705 then is installed in the housing by pushing handle 755 toward the center of plate 705 while inserting plate 705 in housing 110. Plate 705 can be removed later to make wiring changes or to inspect the wiring. The housing may include additional openings to permit other cables to enter and exit the wiring compartment. The housing also may include a grounding connection to ease attachment of a ground wire of the cable to the housing.

Figure 14:
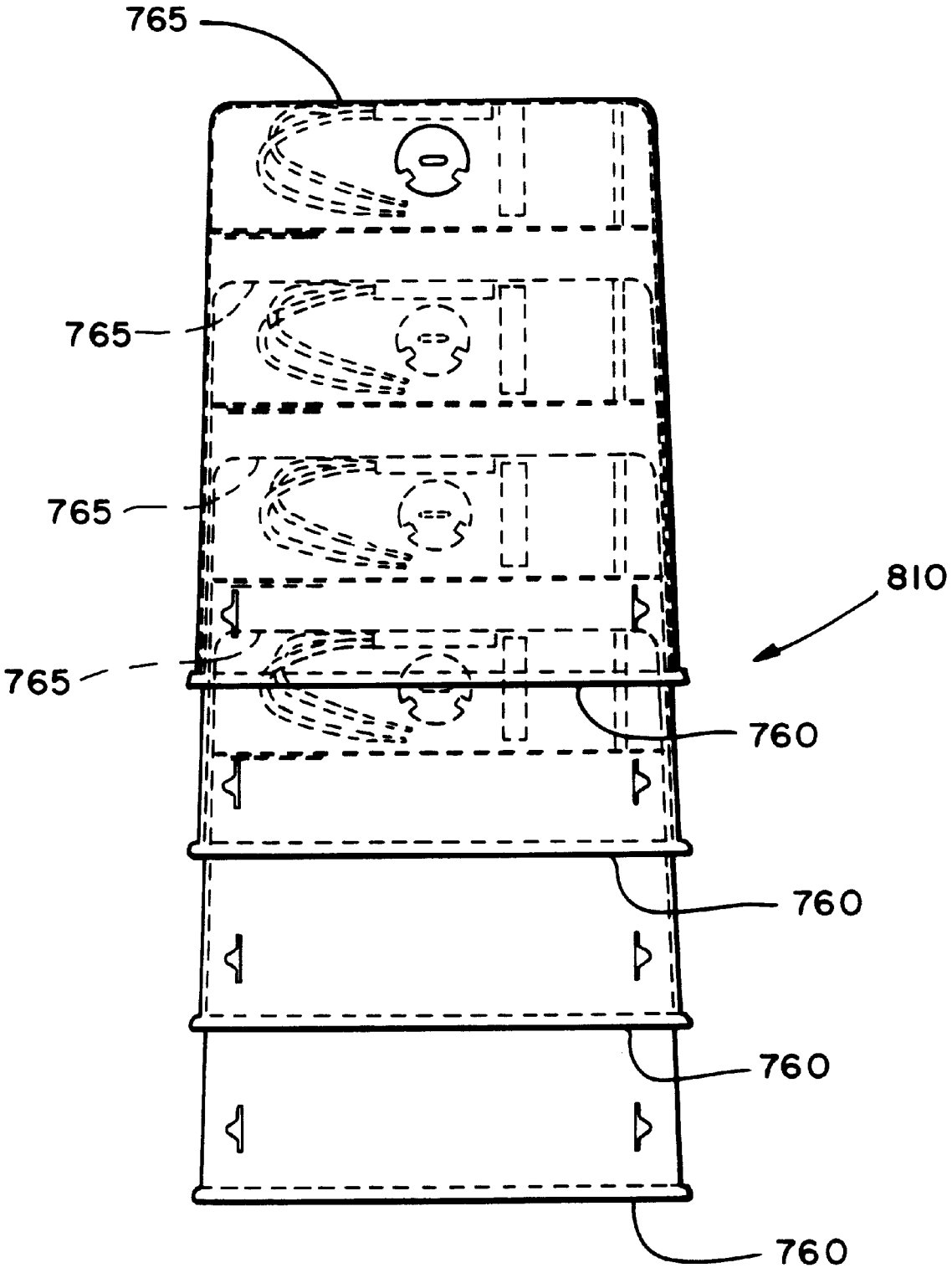
FIG. 14 is a front view of a stack of the housings of FIG. 12.

Referring also to FIG. 14, housing 110 has a tapered shape, with the diameter decreasing from a larger diameter at a wider opening 760 to a smaller diameter at a wiring compartment end 765. Housing 110 also does not have any external projections. Because the opening 760 has a larger diameter than the compartment end 765, end 765 can be inserted into opening 760 to create a stack 810 of multiple housings 110. This permits a large number of housings 110 to be efficiently transported or stored.

Other embodiments are within the scope of the following claims. For example, while the housing with an integral wiring compartment may include a groove for attachment of wireform springs of a trim body 120, the housing also may employ conventional trim mounting techniques. Similarly, a fixture using wireform springs for mounting may use a conventional junction box mounted adjacent to, or on the side of, the housing 110.

What is claimed is:

1. A lighting fixture comprising:

a first open end;

a second end;

a substantially planar, movable dividing plate positioned between the first and second ends to define a light compartment extending from the open end to the plate and a wiring compartment extending from the plate to the second end;

a release mechanism configured to release the plate to move the plate to permit access to the wiring compartment from the first end; and a socket positioned in the light compartment and having a pair of socket wires extending into the wiring compartment.

2. The lighting fixture of claim 1, wherein the second end is closed.

3. The lighting fixture of claim 2, wherein a wall of the wiring compartment includes at least one opening configured to permit insertion of wires into the wiring compartment.

4. The lighting fixture of claim 1, wherein the housing includes at least one opening configured to permit insertion of wires into the wiring compartment.

5. A lighting fixture comprising:

a first open end;

a second end;

a movable dividing plate positioned between the first and second ends to define a light compartment extending from the open end to the plate and a wiring compartment extending from the plate to the second end; and a release mechanism configured to release the plate to move the plate to permit access to the wiring compartment from the first end, wherein the release mechanism comprises:

a slot in the wall of the housing; and a movable tab slidably mounted on the dividing plate and configured to pass through the slot when the dividing plate is installed in the housing.

6. The lighting fixture of claim 5, wherein the dividing plate includes a wireform spring in contact with the movable tab to bias the tab in the slot.

7. The lighting fixture of claim 5, further comprising:

a second slot in the wall of the housing; and a fixed tab on the dividing plate, wherein the fixed tab is configured to pass through the second slot when the dividing plate is installed in the housing.

8. The lighting fixture of claim 1, further comprising a thermal circuit interrupter positioned in the wiring compartment.

9. A lighting fixture comprising:

a first open end;

a second end;

a substantially planar, movable dividing plate positioned between the first and second ends to define a light compartment extending from the open end to the plate and a wiring compartment extending from the plate to the second end;

a release mechanism configured to release the plate to move the plate to permit access to the wiring compartment from the first end;

an open end defining an inner groove;

a reflector having a trim body; and at least one wireform spring attached to the trim body at two points and having a central portion configured to fit in the groove when the trim body is attached to the housing.

10. The lighting fixture of claim 1, wherein the lighting fixture comprises a recessed light fixture housing.

11. The lighting fixture of claim 1, wherein the lighting fixture is generally cylindrical.

12. A lighting fixture comprising:

a first open end;

a second end;

a movable dividing plate positioned between the first and second ends to define a light compartment extending from the open end to the plate and a wiring compartment extending from the plate to the second end; and a release mechanism configured to release the plate to move the plate to permit access to the wiring compartment from the first end, wherein the lighting fixture is generally cylindrical, and is tapered from a wider first end to a narrower second end.

13. The lighting fixture of claim 12, comprised of a plurality of stacked lighting fixtures, wherein the narrower second end of each lighting fixture is inserted into the wider first end of another lighting fixture.

14. A method of wiring a light fixture housing comprising:

providing a lighting fixture comprising a first open end, a second end, a substantially planar, movable dividing plate positioned between the first and second ends to define a light compartment extending from the open end to the plate and a wiring compartment extending from the plate to the second end, and a socket positioned in the light compartment and having a pair of socket wires extending into the wiring compartment;

removing the movable dividing plate by using a release mechanism configured to release the plate to move the plate to permit access to the wiring compartment from the first end;

inserting wires into the wiring compartment;

connecting the wires in the wiring compartment; and positioning the dividing plate in the lighting fixture to close the wiring compartment using the release mechanism.

15. A generally cylindrical, tapered lighting fixture comprising:

a first open end;

a second end, wherein the first end is wider than the second end;

a movable dividing plate positioned between the first and second ends to define a light compartment extending from the first end to the plate and a wiring compartment extending from the plate to the second end;

a release mechanism configured to release the plate to move the plate to permit access to the wiring compartment from the first end, wherein the release mechanism comprises a first slot in the wall of the housing and a movable tab slidably mounted on the dividing plate and configured to pass through the first slot when the dividing plate is installed in the housing;

a second slot in the wall of the housing; and a fixed tab on the dividing plate, wherein the fixed tab is configured to pass through the second slot when the dividing plate is installed in the housing.

16. A stack of the lighting fixtures of claim 15.

17. A stack of more than one lighting fixture, each lighting fixture comprising:

a housing having an open first end, a second end, a substantially planar dividing plate positioned between the first end and the second end; and a cross section the size of which changes between the first and second ends so as to permit the fixtures to be stacked with the second end of one fixture inserted into the first end of an adjacent fixture;

a wiring compartment defined within the housing adjacent to the second end; and a light compartment defined within the housing adjacent to the first end.

* * * * *